US009748742B2

(12) United States Patent
Kawano et al.

(10) Patent No.: US 9,748,742 B2
(45) Date of Patent: Aug. 29, 2017

(54) APPARATUS AND METHOD FOR MANUFACTURING SPARK PLUG

(71) Applicant: NGK SPARK PLUG CO., LTD., Nagoya-shi, Aichi (JP)

(72) Inventors: Hajime Kawano, Konan (JP); Takashi Ukimori, Inuyama (JP); Kyosuke Handa, Toki (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/364,830

(22) Filed: Nov. 30, 2016

(65) Prior Publication Data

US 2017/0179689 A1 Jun. 22, 2017

(30) Foreign Application Priority Data

Dec. 16, 2015 (JP) ..... 2015-244691

(51) Int. Cl.
*H01J 9/00* (2006.01)
*H01J 9/44* (2006.01)
*H01T 21/02* (2006.01)

(52) U.S. Cl.
CPC ..... *H01T 21/02* (2013.01)

(58) Field of Classification Search
CPC ..... H01T 21/02
See application file for complete search history.

(56) References Cited

U.S. PATENT DOCUMENTS 6,790,113 B1 * 9/2004 Fujita ..... H01T 21/02 140/71.5
2009/0007618 A1 * 1/2009 Ohashi ..... H01T 21/02 72/88

FOREIGN PATENT DOCUMENTS

JP 2001-284015 A 10/2001

OTHER PUBLICATIONS

Extended European Search Report issued in corresponding European Patent Application No. 16200442.8, dated May 2, 2017.

* cited by examiner

*Primary Examiner* — Donald Raleigh
(74) *Attorney, Agent, or Firm* — Kusner & Jaffe

(57) ABSTRACT

An apparatus for manufacturing a spark plug by working of a workpiece with dies, wherein the workpiece has a metal shell part to be processed into a metal shell of the spark plug and a ground electrode part to be processed into a ground electrode of the spark plug. In the manufacturing apparatus, a position of the ground electrode part is measured in a non-contact manner by a position measurement unit in a state where the workpiece is held in position by a holding unit. The dies are controlled by a die control unit so as to adjust the working phase of the dies relative to the workpiece based on the measured position of the ground electrode part and then effect working of the workpiece with the dies.

2 Claims, 7 Drawing Sheets

APPARATUS AND METHOD FOR MANUFACTURING SPARK PLUG

FIELD OF THE INVENTION

The present invention relates to an apparatus and method for manufacturing a spark plug.

BACKGROUND OF THE INVENTION

A spark plug is mounted to a cylinder head of an internal combustion engine by screwing into a plug mounting hole of the cylinder head. For this reason, a thread portion is formed on an outer circumferential surface of a metal shell of the spark plug. It is conceivable, at the formation of the thread portion, to adjust the start position of thread forming operation in such a manner that, in a state where the spark plug is mounted to the internal combustion engine, a ground electrode of the spark plug is oriented to a predetermined direction within a combustion chamber of the internal combustion engine.

For example, Japanese Laid-Open Patent Publication No. 2001-284015 (abbreviated as "JP2001-284015A") discloses a manufacturing apparatus of a spark plug, which forms a thread portion by rolling a part of workpiece to be processed into a metal shell of the spark plug with the use of rolling dies.

SUMMARY OF THE INVENTION

The manufacturing apparatus of JP2001-284015A includes a holding unit for holding the workpiece and moving the workpiece to the dies and a feeding unit for feeding the workpiece to the holding unit while supporting the workpiece in a corrected orientation for the adjustment of the thread formation start position. In this type of manufacturing Apparatus, however, there occurs a slight displacement of the workpiece at the time when the feeding unit unloads the workpiece upon feeding of the workpiece to the holding unit. Such a displacement of the workpiece leads to a variation in thread formation start position.

There has thus been a demand to develop a technique for forming a thread portion on a metal shell without causing a variation in thread formation start position.

The present invention has been made to solve at least a part of the above problem and can be embodied as the following application examples (1) to (4).

(1) According to one aspect of the present invention, there is provided a manufacturing apparatus of a spark plug, comprising: a holding unit that holds a workpiece, the workpiece having a shape extending along a center axis thereof and including a metal shell part to be processed into a metal shell of the spark plug and a ground electrode part to be processed into a ground electrode of the spark plug; a feeding unit that feeds the workpiece to the holding unit; dies for working the workpiece to form a thread portion on an outer circumferential surface of the metal shell part; a position measurement unit that measures a position of the ground electrode part in a state where the workpiece is held in position by the holding unit; and a die control unit that controls working of the workpiece with the dies, wherein the dies are capable of changing a working phase of the dies relative to the workpiece; wherein the position measurement unit measures the position of the ground electrode part in a non-contact manner; and wherein the die control unit controls the dies to adjust the working phase of the dies relative to the workpiece based on the measured position of the ground electrode part and then effect working of the workpiece with the dies.

In this spark plug manufacturing apparatus, the position measurement unit measures the position of the ground electrode part in the non-contact manner in the state where the workpiece is held in position by the holding unit; and the die control unit controls the dies to adjust the working phase of the dies relative to the workpiece based on the measured position of the ground electrode part and then start the working operation of the dies. Namely, no physical contact is made with the workpiece from the adjustment of the working phase of the dies until the start of the formation of the thread portion. It is therefore possible to start the formation of the thread portion from the adjusted position without causing a variation in thread formation start position.

(2) In accordance with another aspect of the present invention, there is provided a spark plug manufacturing apparatus as described above, wherein the ground electrode part may be located on one end side of the workpiece at a position displaced from the center axis of the workpiece; and the position measurement unit may measure the position of the ground electrode part by emitting laser light to the ground electrode part from a direction perpendicular to the center axis of workpiece.

In this case, it is possible to accurately specify the measurement target area on the ground electrode part by emission of the laser light. It is further possible to accurately measure the position of the ground electrode part by direct emission of the laser light.

(3) In accordance with yet another aspect of the present invention, there is provided a spark plug manufacturing apparatus as described above, wherein the ground electrode part may be located on one end side of the workpiece at a position displaced from a center axis of the workpiece; and the position measurement unit may measure the position of the ground electrode part by taking and analyzing an image of the ground electrode part.

Even in this case, it is possible to accurately measure the position of the ground electrode part.

(4) According to still another aspect of the present invention, there is provided a manufacturing method of a spark plug, comprising: a holding step of holding a workpiece, the workpiece having a shape extending along a center axis thereof and including a metal shell part to be processed into a metal shell of the spark plug and a ground electrode part to be processed into a ground electrode of the spark plug; a measuring step of measuring a position of the ground electrode part in a state where the workpiece is held in position; and a controlling step of controlling working of the workpiece with dies to form a thread portion on an outer circumferential surface of the metal shell part, wherein, in the measuring step, the position of the ground electrode part is measured in a non-contact manner; and wherein the controlling step includes adjusting a working phase of the dies relative to the workpiece based on the measured position of the ground electrode part and then effecting working of the workpiece with the dies.

It is possible by this spark plug manufacturing method to obtain the same effects as mentioned above.

It is herein noted that: the present invention can be embodied as, but are not limited to, not only a manufacturing apparatus and method of a spark plug but also a spark plug for an internal combustion engine, an engine system with such a spark plug and a vehicle with such an engine system;

and various embodiments of the present invention are possible without departing from the technical scope of the present invention.

The other advantages and features of the present invention will also become understood from the following description.

DESCRIPTION OF EMBODIMENTS

The present invention will be described below with reference to the drawings.

A. Embodiment

A-1. Structure of Spark Plug

Figure 1:
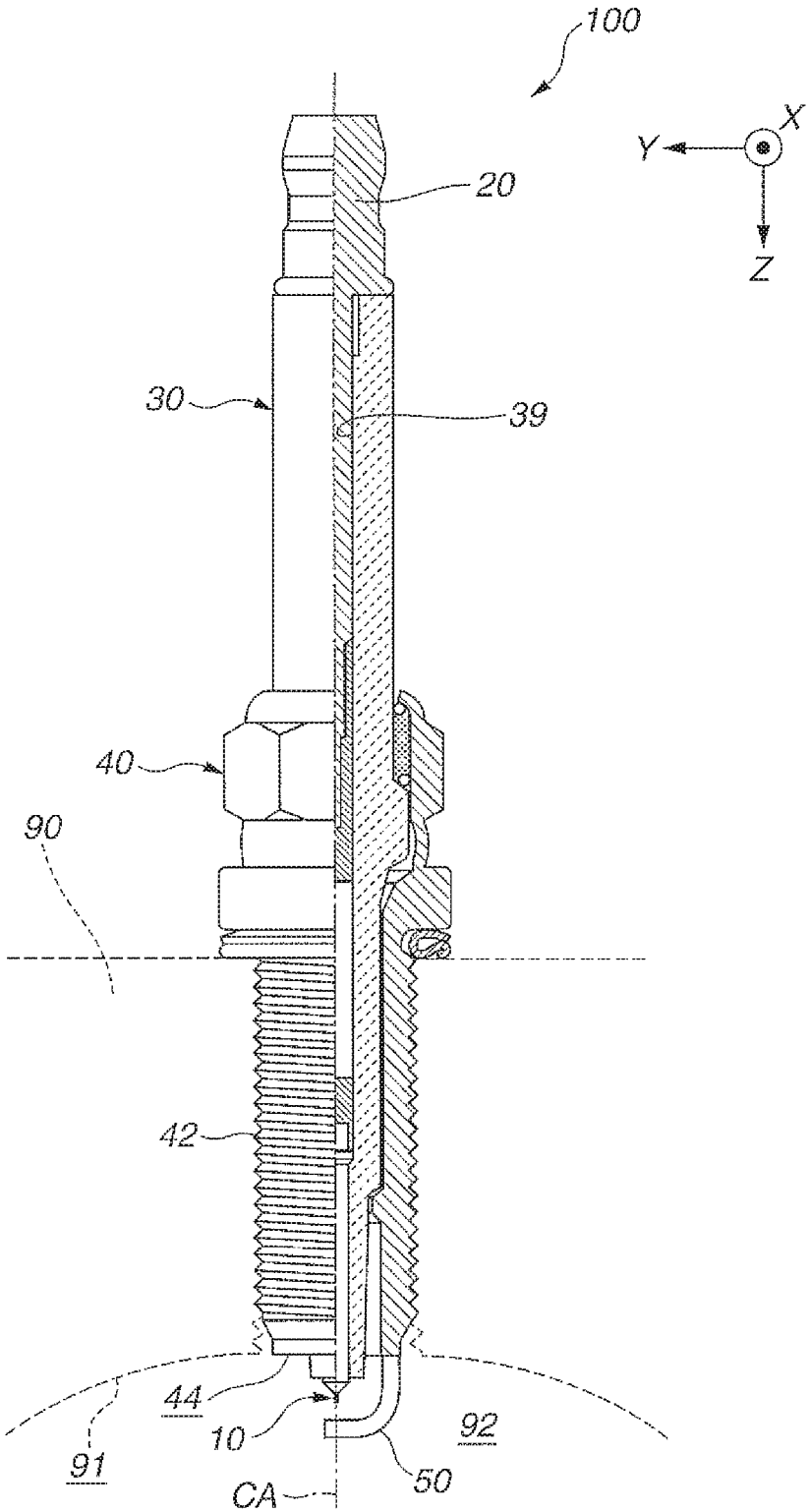
FIG. 1 is a schematic view, partially in section, of a spark plug to which the present invention is applicable.

FIG. 1 is a schematic view, partially in section, of a spark plug 100 for an internal combustion engine 90 according to one embodiment of the present invention. In FIG. 1, a center axis (center line) of the spark plug 100 is designated as CA. The left side of FIG. 1 with respect to the axis CA shows an appearance of the spark plug 100, whereas the right side of FIG. 1 with respect to the axis CA shows a cross section of the spark plug 100. In the following description, the top and bottom sides of FIG. 1 are referred to as rear and front sides, respectively. The X, Y and Z axis directions of FIG. 1 correspond to those of the other figures. As shown in the figures, the axis CA of the spark plug 100 extends in the Z axis direction.

The spark plug 100 includes a center electrode 10, a metal terminal 20, an insulator 30, a metal shell 40 and a ground electrode 50. In the present embodiment, the center axes (center lines) of the center electrode 10, the metal terminal 20, the insulator 30 and the metal shell 40 are in agreement with the axis CA of the spark plug 100.

In a front end side of the spark plug 100, a spark discharge gap is defined between the center electrode 10 and the ground electrode 50. The spark plug 100 is mounted to the internal combustion engine 90, with the front end side of the spark plug 100 (in which the spark discharge gap is defined) protruding inside a combustion chamber 92 of the internal combustion engine 90 from an inner wall 91 of the combustion chamber 92. In this mounted state, the spark plug 100 generates a spark discharge in the spark discharge gap with the application of a high voltage (e.g. 10,000 to 30,000 volts) to the center electrode 10, whereby an air-fuel mixture is ignited by the spark discharge within the combustion chamber 92.

The insulator 30 is made of an electrically insulating material such as sintered insulating ceramic material (e.g. alumina) in a cylindrical shape about the axis CA. An axial hole 39 is formed through the insulator 30 along the direction of the axis CA.

The center electrode 10 is made of a conductive material in a rod shape and is fitted in a front end side of the axial hole 39 of the insulator 30, with an outer circumferential surface of the center electrode 10 kept electrically insulated by the insulator 30 from the outside and a front end of the center electrode 10 protruding from a front end of the insulator 30.

The metal terminal 20 is also made of a conductive material and is fitted in a rear end side of the axial hole 39 of the insulator 30 so as to make an electrical connection to the center electrode 10 for power supply from an external power source to the center electrode 10. A rear end portion of the center electrode 10 is electrically connected to a rear end portion of the insulator 30 via the metal terminal 30.

The metal shell 40 is made of a conductive metal material (e.g. low carbon steel with nickel plating) in a cylindrical shape and is disposed around an outer circumference of the insulator 30. A thread portion 42 is formed on an outer circumferential surface of a front end side of the metal shell 40 such that the spark plug 100 is mounted to the internal combustion engine 90 by screwing the thread portion 42 into a plug mounting hole of the internal combustion engine 90.

As shown in FIG. 1, both of the front ends of the center electrode 10 and the insulator 30 protrude toward the front (+Z axis side) from a front end face 44 of the metal shell 40.

The ground electrode 50 is made of a conductive material (e.g. nickel-based alloy) in a bent rod shape and is joined at one end thereof to the front end face 44 of the metal shell 40, with one end side of the ground electrode 50 extending from the front end face 44 of the metal shell toward the front along the direction of the axis CA and the other end side of the ground electrode 50 extending toward the axis CA.

Figure 2:
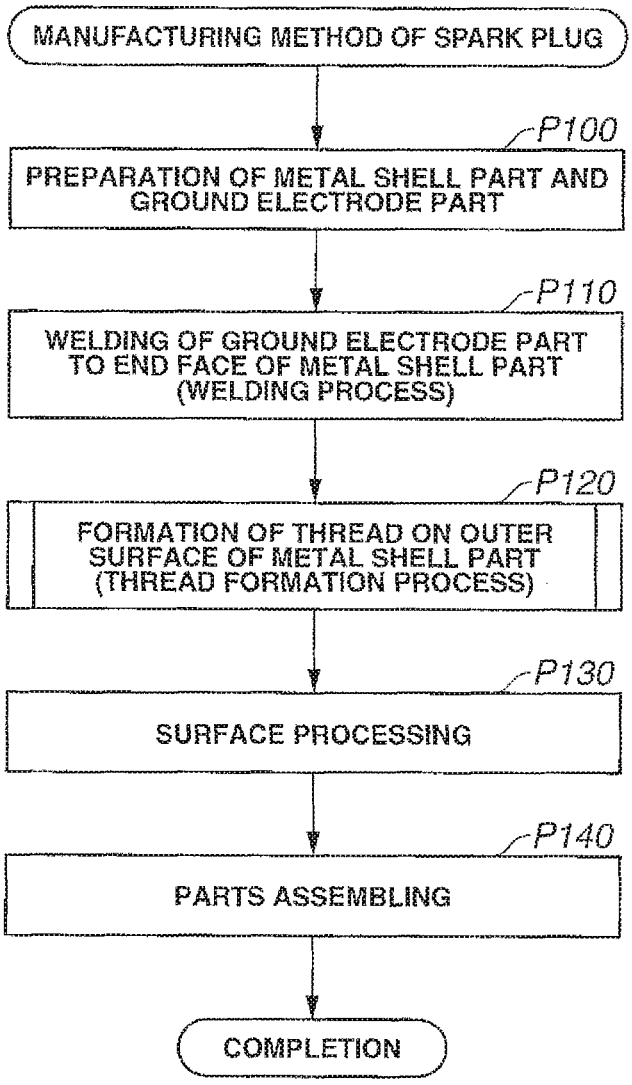
FIG. 2 is a flowchart of a method for manufacturing the spark plug by means of a spark plug manufacturing apparatus according to one embodiment of the present invention.

FIG. 2 is a flowchart of a method for manufacturing the spark plug 100 by means of the after-mentioned spark plug manufacturing apparatus 200 in the present embodiment.

In process P100, a metal shell part 40P (as a raw product for the metal shell 40) is prepared by press forming and cutting. In the present embodiment, the metal shell part 40P is cylindrical-shaped about the axis CA and is not provided with the thread portion 42. Further, a ground electrode part 50P (as a raw product for the ground electrode 50) is prepared in process P100. In the present embodiment, the ground electrode part 50P is not yet bent and is straight rod-shaped having a rectangular cross section as taken perpendicular to the axis CA (Z axis direction; see FIG. 3).

In process P110, one end of the ground electrode part 50P is joined by welding to the end face 44 of the metal shell part 40P. In the present embodiment, the ground electrode part 50P is welded to the metal shell part 40P at a position displaced from the center axis of the metal shell part 40P (i.e. displaced from the axis CA).

In process P120, the metal shell part 40 is subjected to working such that the thread portion 42 is formed on the outer circumferential surface of the metal shell part 40. The working may be done by cutting, rolling etc.

After that, surface processing such as plating is performed on the metal shell part 40 in process S130. With this, the metal shell 40 is completed.

In process P140, the other component parts (the center electrode 10, the metal terminal 20, the insulator 30 etc.) are assembled to the metal shell 40. In the present embodiment, the ground electrode part 50P is subjected to bending in this process.

Figure 3:
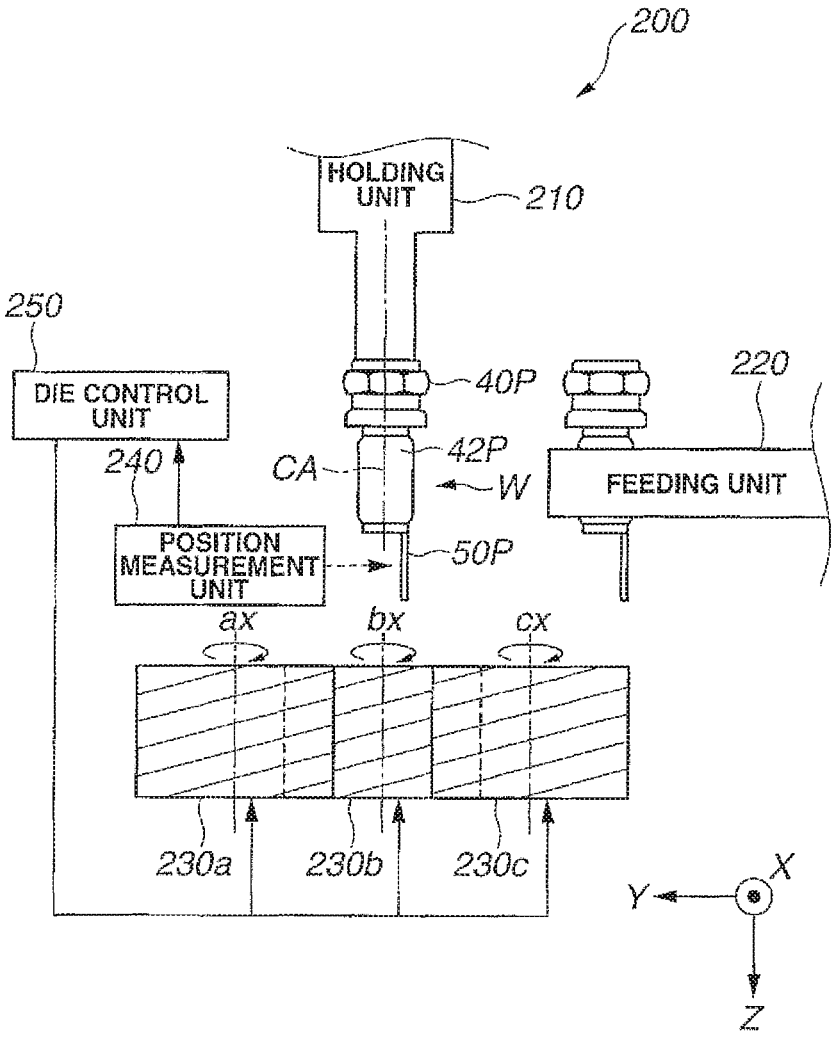
FIG. 3 is a schematic view of the spark plug manufacturing apparatus according to the one embodiment of the present invention.

FIG. 3 is a schematic view of the spark plug manufacturing apparatus 200 used in the thread formation process P120.

The spark plug manufacturing apparatus 200 includes a holding unit 210, a feeding unit 220, three dies 230*a*, 230*b* and 230*c* (also generically designated by 230), a position measurement unit 240 and a die control unit 250.

Hereinafter, the product of the welding process P110 in which the ground electrode part 50P has been joined to the end face 44 of the metal shell part 40P is referred to as "workpiece W". It can thus be said that: the metal shell part 40P and the ground electrode part 50P are parts of the workpiece W to be processed into the metal shell 40 and the ground electrode 50, respectively; and the workpiece W has a shape extending along the axis CA.

The holding unit 210 is adapted to hold the workpiece W. More specifically, the holding unit 210 holds the workpiece W by being inserted from its +Z axis side into the cylindrical metal shell part 40P of the workpiece W. The holding unit 210 shifts downward toward the +Z axis side while holding the workpiece W, and thereby moves the workpiece W to a location of the dies 230 in the Z axis direction.

The feeding unit 220 is adapted to feed the workpiece W to the holding unit 210. More specifically, the feeding unit 220 shifts toward the +Y axis side while supporting the workpiece W, and thereby moves the workpiece W to a position on the +Z axis side of the holding unit 210 such that the holding unit 210 can be inserted into and hold the workpiece W by its downward motion.

In the present embodiment, the workpiece W is fed from the feeding unit 220 to the holding unit 210 in a corrected orientation within a certain range with respect to a predetermined direction. It is feasible to correct the orientation of the workpiece W, by the feeding unit 220 or by another means, before, after or during moving the workpiece W. For example, the orientation of the workpiece W is corrected to within the range of 3 degrees with respect to the predetermined direction. The orientation of the workpiece W may alternatively be corrected to within the range of e.g. 3 to 50 degrees with respect to the predetermined direction.

Figure 4:
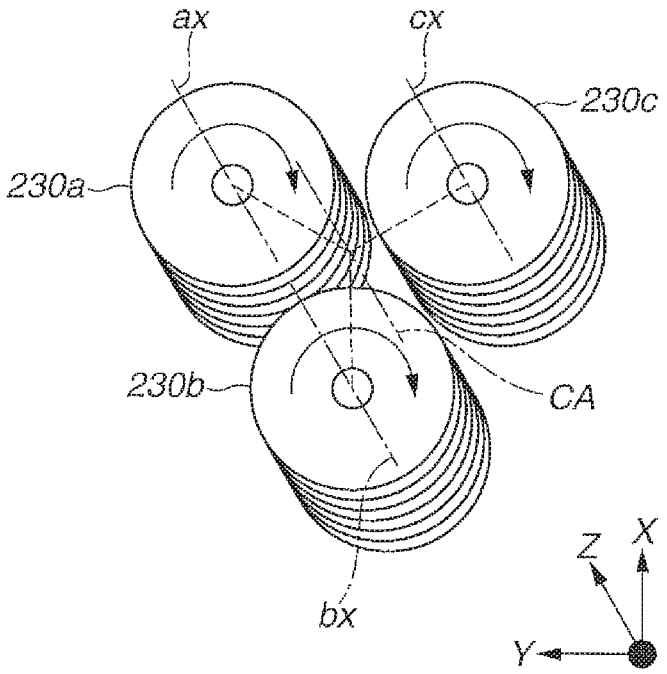
FIG. 4 is a perspective view showing the arrangement of dies in the spark plug manufacturing apparatus according to the one embodiment of the present invention.

FIG. 4 is a perspective view showing the arrangement of the dies 230*a*, 230*b* and 230*c*. For ease of understanding, only the dies 230*a*, 230*b* and 230*c* are illustrated in FIG. 4. The dies 230*a*, 230*b* and 230*c* are located at intervals of 120 degrees around the axis CA, as shown in FIG. 4, so as to be rotatable about their respective axes ax, bx and cx. The axes ax, bx and cx of the dies 230*a*, 230*b* and 230*c* are parallel to each other and are parallel to the axis CA.

The dies 230*a*, 230*b* and 230*c* are used to work the outer circumferential surface 42P of the metal shell part 40P of the workpiece W and thereby form the thread portion 42 on the outer circumferential surface 42P of the metal shell part 40P during the thread formation process. In the present embodiment, the dies 230*a*, 230*b* and 230*c* are arranged to be able to change a working phase of the dies 230*a*, 230*b* and 230*c* relative to the workpiece W (i.e. a phase at which the dies 230*a*, 230*b* and 230*c* effect working of the workpiece W) for the formation of the thread portion 42 on the metal shell part 40P.

Referring back to FIG. 3, the position measurement unit 240 is adapted to measure the position of the ground electrode part 50P of the workpiece W in a state where the workpiece W is held in position by the holding unit 210. In the present embodiment, the position measurement unit 240 measures the position of the ground electrode part 50P in a non-contact manner and, more specifically, by directly emitting laser light onto the ground electrode part 50P from the +Y axis side and detecting/analyzing a reflected component of the laser light from the ground electrode part 50P. Alternatively, the position measurement unit 240 may have a light receiving portion to receive a component of the laser light unreflected from the ground electrode part 50P and measure the position of the ground electrode part 50P by analysis of the unreflected light component. Then, the position measurement unit 240 outputs a signal indicating the measured position of the ground electrode part 50P (referred to as "ground electrode position signal") to the die control unit 250.

As mentioned above, the ground electrode part 50P is displaced from the center axis of the metal shell part 40P (i.e. displaced from the axis CA) in the present embodiment. The orientation of the workpiece W can be thus determined based on the position of the ground electrode part 50P measured from the +Y axis side.

By emission of the laser light, it is possible for the position measurement unit 240 to accurately specify the measurement target area on the ground electrode part 50P. It is further possible to accurately measure the position of the ground electrode part 50P by direct emission of the laser light.

The die control unit 250 is adapted to control working of the workpiece W with the dies 230 upon receipt of the ground electrode position signal from the position measurement unit 240. In the present embodiment, the die control unit 250 controls the dies 230 to adjust the working phase of the dies 230 relative to the workpiece W based on the ground electrode position signal and then effect working of the workpiece W with the dies 230.

Figure 5:
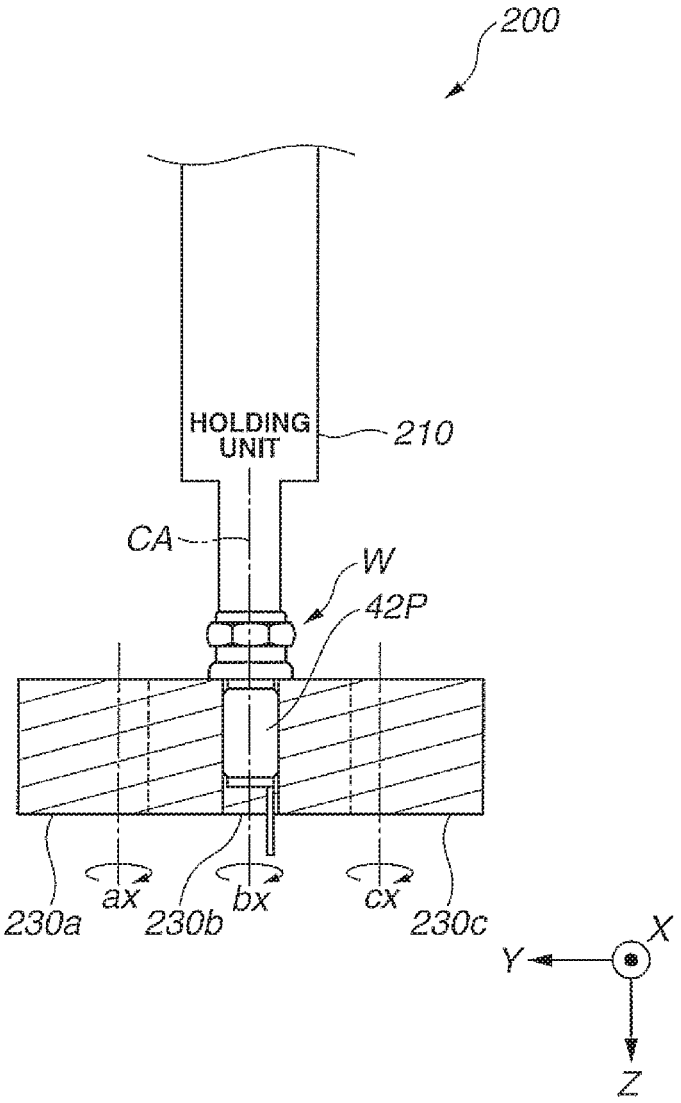
FIG. 5 is a schematic view showing a state of working a workpiece with the dies in the spark plug manufacturing apparatus according to the one embodiment of the present invention.
Figure 6:
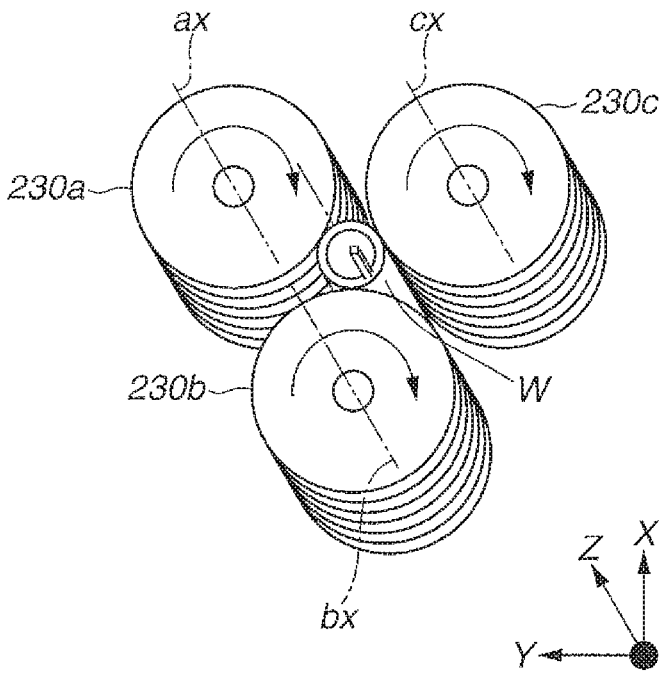
FIG. 6 is a perspective view showing the state of working the workpiece with the dies in the spark plug manufacturing apparatus according to the one embodiment of the present invention.

FIGS. 5 and 6 are a schematic view and a perspective view showing a state of working the workpiece W with the dies 230. For ease of understanding, only the workpiece W, the holding unit 210 and the dies 230*a*, 230*b* and 230*c* are illustrated in FIG. 5; and only the workpiece W and the dies 230*a*, 230*b* and 230*c* are illustrated in FIG. 6. In FIGS. 5 and 6, the workpiece W has been moved by the holding unit 210 to the location of the dies 230 in the Z axis direction. In this illustrated state, the workpiece W is worked with the dies 230 so that the thread portion 42 is formed on the metal shell part 40P.

Figure 7:
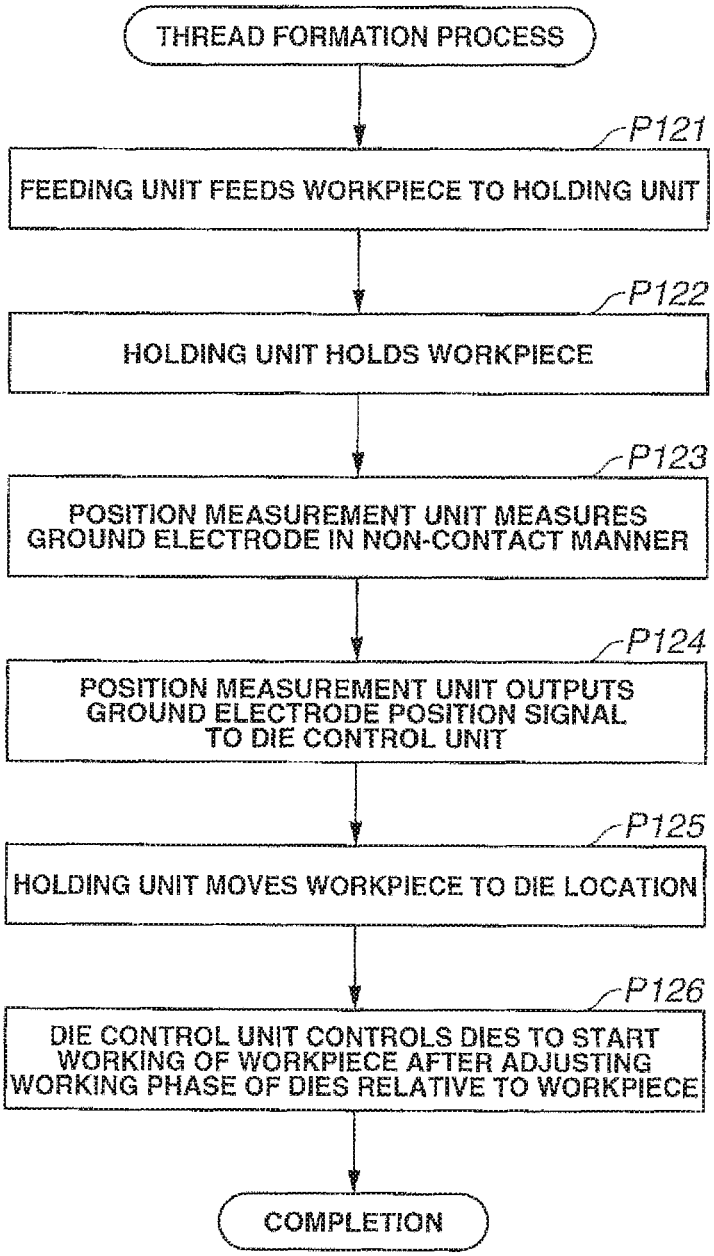
FIG. 7 is a flowchart of thread formation process of the spark plug manufacturing apparatus according to the one embodiment of the present invention.

FIG. 7 is a flowchart of the thread formation process P120 (see FIG. 2) of the spark plug manufacturing apparatus 200. This thread formation process P120 is started after the completion of the welding process P110.

First, the feeding unit 220 feeds the workpiece W to the holding unit 210 in step P121.

In step P122, the holding unit 210 holds the workpiece W fed by the feeding unit 220.

In step P123, the position measurement unit 240 measures, from the +Y axis side, the position of the ground electrode part 50P of the workpiece W held by the holding unit 210.

In step P124, the position measurement unit 240 outputs the ground electrode position signal to the die control unit 250.

In step P125, the holding unit 210 moves the workpiece W to the dies 230.

In step P126, the die control unit 250 controls the dies 230 so as to adjust the working phase of the dies 230 relative to the workpiece W based on the ground electrode position signal and start working of the workpiece W with the dies 230.

Through these process steps, the thread portion 42 is formed on the metal shell part 40P of the workpiece W.

As explained above, the spark plug manufacturing apparatus 220 is configured to measure the position of the ground electrode part 50P of the workpiece W in the non-contact manner in the state where the workpiece W is held in position by the holding unit 210, and adjust the working phase of the dies 230 relative to the workpiece W based on the measured position of the ground electrode part 50P. No physical contact is made with the workpiece W from the adjustment of the working phase of the dies 230 until the start of the formation of the thread portion 42 by the dies 230. It is therefore possible to start the formation of the thread portion 42 by the dies 230 without causing a variation in thread formation start position.

B. Modifications

In the above embodiment, the position measurement unit 240 measures the position of the ground electrode part 50P in the non-contact manner by emission of the laser light. However, the non-contact position measurement of the position measurement unit 240 is not limited to such a technique. The position measurement unit 240 may alternatively measure the position of the ground electrode part 50P in the non-contact manner by taking an image of the ground electrode part 50P and performing analysis of the taken image.

Although the holding unit 210 moves the workpiece W to the dies 230 (process P125) after the position measurement unit 240 outputs the ground electrode position signal to the die control unit 350 (process P124) in the above embodiment, the present invention is not limited to such process sequence. Alternatively, the position measurement unit 240 may output the ground electrode position signal to the die control unit 350 (process P124) after the holding unit 210 moves the workpiece W to the dies 230 (process P125). These two processes (process P124 and process P125) may be carried out simultaneously in parallel to each other. Furthermore, it is feasible to adjust the working phase of the dies 230 relative to the workpiece W based on the ground electrode position signal while moving the workpiece W to the dies 230 by the holding unit 210 (process P125).

The entire contents of Japanese Patent Application No. 2015-244691 (filed on Dec. 16, 2015) are herein incorporated by reference.

The present invention is not limited to the above specific embodiments, examples and modifications and can be embodied in various forms without departing from the scope of the present invention. For example, it is possible to appropriately replace or combine any of the technical features mentioned above in "Summary of the Invention" and "Description of the Embodiments" in order to solve part or all of the above-mentioned problems or achieve part or all of the above-mentioned effects. Any of these technical features, if not explained as essential in the present specification, may be eliminated as appropriate. The scope of the invention is defined with reference to the following claims.

Having described the invention, the following is claimed:

1. A manufacturing apparatus of a spark plug, comprising:

a holding unit that holds a workpiece, the workpiece having a shape extending along a center axis thereof and including a metal shell part to be processed into a metal shell of the spark plug and a ground electrode part to be processed into a ground electrode of the spark plug, the ground electrode part being located on one end side of the workpiece at a position displaced from the center axis of the workpiece;

a feeding unit that feeds the workpiece to the holding unit;

dies for working the workpiece to form a thread portion on an outer circumferential surface of the metal shell part;

a position measurement unit that measures a position of the ground electrode part in a state where the workpiece is held in position by the holding unit; and a die control unit that controls working of the workpiece with the dies, wherein the die control unit is capable of changing a working phase of the dies relative to the workpiece;

wherein the position measurement unit measures the position of the ground electrode part by emitting laser light to the ground electrode part from a direction perpendicular to the center axis of the workpiece; and wherein the die control unit controls the dies to adjust the working phase of the dies relative to the workpiece based on the measured position of the ground electrode part and then effects working of the workpiece with the dies.

2. A method for manufacturing a spark plug, comprising:

a holding step of holding a workpiece, the workpiece having a shape extending along a center axis thereof and including a metal shell part to be processed into a metal shell of the spark plug and a ground electrode part to be processed into a ground electrode of the spark plug, the ground electrode part being located on one end side of the workpiece at a position displaced from the center axis of the workpiece;

a measuring step of measuring a position of the ground electrode part in a state where the workpiece is held in position; and a controlling step of controlling working of the workpiece with dies to form a thread portion on an outer circumferential surface of the metal shell part, wherein, in the measuring step, the position of the ground electrode part is measured by emitting laser light to the ground electrode part from a direction perpendicular to the center axis of the workpiece; and wherein the controlling step includes adjusting a working phase of the dies relative to the workpiece based on the measured position of the ground electrode part and then effecting working of the workpiece with the dies.

* * * * *